US010473108B2

(12) United States Patent
Post et al.

(10) Patent No.: US 10,473,108 B2
(45) **Date of Patent: *Nov. 12, 2019**

(54) BLOWER MOTOR ASSEMBLY HAVING AIR DIRECTING SURFACE

(71) Applicant: Regal Beloit America, Inc., Beloit, WI (US)

(72) Inventors: Steven W. Post, Cassville, MO (US); William S. Gatley, Jr., Cassville, MO (US)

(73) Assignee: REGAL BELOIT AMERICA, INC., Beloit, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/687,971

(22) Filed: Aug. 28, 2017

(65) Prior Publication Data

US 2018/0010610 A1 Jan. 11, 2018

Related U.S. Application Data

(63) Continuation of application No. 13/627,587, filed on Sep. 26, 2012, now Pat. No. 9,777,735.

(Continued)

(51) Int. Cl.

| | |
|---|---|
| ***F04D 25/06*** | (2006.01) |
| ***F04D 29/42*** | (2006.01) |
| ***F04D 29/58*** | (2006.01) |

(52) U.S. Cl.

CPC ..... *F04D 25/068* (2013.01); *F04D 29/4213* (2013.01); *F04D 29/5813* (2013.01)

(58) Field of Classification Search

CPC . F04D 29/5813; F04D 29/4213; F04D 25/068

(Continued)

(56) References Cited

U.S. PATENT DOCUMENTS

| | | | |
|---|---|---|---|
| 3,223,313 | A | 12/1965 | Kinsworthy |
| 3,571,637 | A | 3/1971 | Henningsen et al. |

(Continued)

FOREIGN PATENT DOCUMENTS

| | | | |
|---|---|---|---|
| CN | 2575336 | Y | 9/2003 |
| CN | 1315246 | C | 5/2007 |

(Continued)

OTHER PUBLICATIONS

Extended European Search Report for EP Application 13820440.9 dated Apr. 8, 2016.

(Continued)

*Primary Examiner* — Charles G Freay
*Assistant Examiner* — Lilya Pekarskaya
(74) *Attorney, Agent, or Firm* — Thompson Coburn LLP

(57) ABSTRACT

A blower assembly includes a centrifugal fan and a motor assembly. The centrifugal fan has a plurality of axially extending impeller blades, a first axial end, and an air inlet. The air inlet is at the first axial end of the centrifugal fan. The motor assembly comprises a stator, a rotor, and an air directing surface. The air directing surface is shaped and configured to direct air drawn into the air inlet radially outwardly toward the impeller blades. The air directing surface extends generally along the rotor axis from its first end to its second end. At least a surface region of the air directing surface generally circumscribes the rotor axis and diverges radially outwardly as such surface region of the air directing surface extends away from the first end toward the second end.

28 Claims, 6 Drawing Sheets

Related U.S. Application Data

(60) Provisional application No. 61/674,099, filed on Jul. 20, 2012.

(58) Field of Classification Search
USPC ..... 417/423.7, 423.15; 415/102, 204, 206; 416/170 R, 178, 185, 186 R, 187, 223 B
See application file for complete search history.

(56) References Cited

U.S. PATENT DOCUMENTS

| | | | |
|---|---|---|---|
| 3,775,029 | A | 11/1973 | Ranz |
| 4,428,719 | A | 1/1984 | Hayashibara et al. |
| 5,746,577 | A | 5/1998 | Ito et al. |
| 5,874,796 | A | 2/1999 | Petersen |
| 5,927,947 | A | 7/1999 | Botros |
| 5,988,979 | A | 11/1999 | Wang |
| 6,076,795 | A | 6/2000 | Scheldel et al. |
| 6,146,094 | A | 11/2000 | Obana et al. |
| 7,112,910 | B2 | 9/2006 | Lopatinsky et al. |
| 9,103,349 | B2 | 8/2015 | Oi et al. |
| 2003/0235496 | A1 | 12/2003 | Eaton et al. |
| 2005/0140233 | A1 | 6/2005 | Kojima et al. |
| 2007/0098571 | A1 | 5/2007 | Nagamatsu |
| 2008/0001488 | A1 | 1/2008 | Pyrhonen et al. |
| 2008/0200113 | A1 | 8/2008 | Munn et al. |
| 2008/0232962 | A1 | 9/2008 | Agrawal et al. |
| 2009/0114205 | A1 | 5/2009 | Post |
| 2009/0114206 | A1 | 5/2009 | Post |
| 2009/0274551 | A1 | 11/2009 | Messmer |
| 2010/0019613 | A1 | 1/2010 | Saban et al. |
| 2010/0254826 | A1 | 10/2010 | Streng et al. |
| 2010/0316511 | A1 | 12/2010 | Yen et al. |
| 2011/0114073 | A2 | 5/2011 | Post |
| 2011/0229358 | A1 | 9/2011 | Streng et al. |
| 2011/0243720 | A1 | 10/2011 | Post |
| 2011/0318200 | A1 | 12/2011 | Takeshita |

FOREIGN PATENT DOCUMENTS

| | | | |
|---|---|---|---|
| CN | 101006635 | A | 7/2007 |
| EP | 0408221 | A2 | 1/1991 |
| EP | 1081386 | A2 | 3/2001 |
| EP | 1536142 | A1 | 6/2005 |
| FR | 2772437 | A1 | 6/1999 |
| GB | 1403522 | A | 8/1975 |
| GB | 2255452 | A | 11/1992 |
| GB | 2260576 | A | 4/1993 |
| JP | 2005-291050 | A | 10/2005 |
| WO | 2002/003527 | A2 | 1/2002 |
| WO | 2011/119574 | A1 | 9/2011 |
| WO | 2012/012547 | A1 | 1/2012 |

OTHER PUBLICATIONS

International Preliminary Report on Patenability (Chapter II) for PCT/US2011/044702 dated Aug. 16, 2012.

International Preliminary Report on Patentability (Chapter I) for PCT/US2011/029378 dated Sep. 12, 2012.

International Search Report and Written Opinion for PCT/US2011/044702 dated Dec. 22, 2011.

International Search Report and Written Opinion for PCT/US2013/046605 dated Nov. 27, 2013.

Translation of the European Patent EP1081386, "Axial flux electric motor", Mar. 7, 2001, Strelow.

BLOWER MOTOR ASSEMBLY HAVING AIR DIRECTING SURFACE

CROSS REFERENCE TO RELATED APPLICATIONS

This application is a continuation of U.S. patent application Ser. No. 13/627,587 filed Sep. 26, 2012, which claims the benefit of U.S. Provisional Patent Application No. 61/674,099 filed Jul. 20, 2012, the disclosures of which are incorporated herein by reference in their entireties.

SUMMARY OF INVENTION

Generally, a blower assembly of the present invention includes a centrifugal fan and a motor assembly. The centrifugal fan is rotatable about a fan axis. The centrifugal fan has a plurality of axially extending impeller blades, a first axial end, and an air inlet. The air inlet is at the first axial end of the centrifugal fan. The impeller blades have inner surfaces that combine to define a fan inner diameter $d_f$. The motor assembly comprises a stator, a rotor, and an air directing surface. The rotor is configured to rotate relative to the stator for rotation about a rotor axis. The centrifugal fan is coupled to the rotor in a manner such that the centrifugal fan rotates with the rotor about the rotor axis. The air directing surface is shaped and configured to direct air drawn into the air inlet radially outwardly toward the impeller blades. The air directing surface has a first end and a second end. The air directing surface extends generally along the rotor axis from the first end to the second end. At least a surface region of the air directing surface generally circumscribes the rotor axis and diverges radially outwardly as such surface region of the air directing surface extends away from the first end of the air directing surface and toward the second end of the air directing surface. The surface region of the air directing surface is axially aligned with portions of the impeller blades such that said surface region of the air directing surface is surrounded by the portions of the impeller blades. The first end of the air directing surface has a diameter $d_1$ and the second end of the air directing surface has a diameter $d_2$, wherein the diameter $d_1$ is less than 50% of the diameter $d_2$ and wherein the diameter $d_2$ is at least 50% of the fan inner diameter $d_f$.

Another aspect of the present invention is a motor assembly adapted for use in a blower assembly. The motor assembly comprises a stator, a rotor, and an air directing surface. The rotor is configured to rotate relative to the stator for rotation about a rotor axis. The air directing surface is shaped and configured to direct air moving generally axially along the rotor axis radially outwardly. The air directing surface has a first end and a second end. The air directing surface extends generally along the rotor axis from the first end to the second end. At least a surface region of the air directing surface generally circumscribes the rotor axis and diverges radially outwardly as such surface region of the air directing surface extends away from the first end of the air directing surface and toward the second end of the air directing surface. The first end of the air directing surface has a diameter $d_1$ and the second end of the air directing surface has a diameter $d_2$, wherein the diameter $d_1$ is less than 50% of the diameter $d_2$. The axial distance between the first and second ends of the air directing surface is at least 25% of the diameter $d_2$.

Another aspect of the present invention is a first blower assembly comprising a centrifugal fan and a motor assembly. The centrifugal fan is rotatable about a fan axis. The centrifugal fan has a plurality of axially extending impeller blades, a first axial end, and an air inlet. The air inlet is at the first axial end of the centrifugal fan. The impeller blades have inner surfaces that combine to define a fan inner diameter $d_f$. The motor assembly comprises a stator, a rotor, and an air directing surface. The rotor is configured to rotate relative to the stator for rotation about a rotor axis. The centrifugal fan is coupled to the rotor in a manner such that the centrifugal fan rotates with the rotor about the rotor axis. The air directing surface is shaped and configured to direct air drawn into the air inlet radially outwardly toward the impeller blades. The air directing surface has a first end and a second end. The air directing surface extends generally along the rotor axis from the first end to the second end. At least a surface region of the air directing surface generally circumscribes the rotor axis and diverges radially outwardly as such surface region of the air directing surface extends away from the first end of the air directing surface and toward the second end of the air directing surface. The surface region of the air directing surface is axially aligned with portions of the impeller blades such that the surface region of the air directing surface is surrounded by the portions of the impeller blades. The air directing surface is shaped and configured such that to produce a given flow and pressure, the air directing surface reduces the energy required to power the blower assembly by at least 5% over the energy required to power a second blower assembly that is identical to the first blower assembly with the exception that the second blower assembly is devoid of an air directing surface.

Another aspect of the present invention is a first blower assembly comprising a centrifugal fan and a motor assembly. The centrifugal fan is rotatable about a fan axis. The centrifugal fan has a plurality of axially extending impeller blades, a first axial end, and an air inlet. The air inlet is at the first axial end of the centrifugal fan. The impeller blades have inner surfaces that combine to define a fan inner diameter $d_f$. The motor assembly comprises a stator, a rotor, an air deflector member and an air directing surface. The rotor is configured to rotate relative to the stator for rotation about a rotor axis. The centrifugal fan is coupled to the rotor in a manner such that the centrifugal fan rotates with the rotor about the rotor axis. The air directing surface is shaped and configured to direct air drawn into the air inlet radially outwardly toward the impeller blades. The air directing surface has a first end and a second end. The air directing surface extends generally along the rotor axis from the first end to the second end. At least a surface region of the air directing surface generally circumscribes the rotor axis and diverges radially outwardly as such surface region of the air directing surface extends away from the first end of the air directing surface and toward the second end of the air directing surface. A surface of the air deflector member comprises at least a portion of the surface region of the air directing surface. The surface region of the air directing surface is axially aligned with portions of the impeller blades such that the surface region of the air directing surface is surrounded by said portions of the impeller blades. The air deflector member is shaped and configured such that to produce a given flow and pressure, the air deflector member reduces the energy required to power the motor assembly by at least 5% over the energy required to power a motor assembly of a second blower assembly that is identical to the first blower assembly with the exception that the second blower assembly is devoid of an air deflector member.

Another aspect of the present invention is a first blower assembly comprising a centrifugal fan, a blower housing, and a motor assembly. The centrifugal fan is rotatable about a fan axis. The centrifugal fan has a plurality of axially extending impeller blades, a first axial end, a second axial end opposite the first axial end, a first air inlet, and a second air inlet. The first air inlet is at the first axial end of the centrifugal fan. The second air inlet is at the second axial end of the centrifugal fan. The impeller blades have inner surfaces that combine to define a fan inner diameter $d_f$. The centrifugal fan is journaled to the blower housing for rotation of the centrifugal fan relative to the blower housing about the fan axis. The blower housing includes first and second housing air inlets. The first housing air inlet is generally adjacent the first air inlet of the centrifugal fan. The second housing air inlet is generally adjacent the second air inlet of the centrifugal fan. The motor assembly comprises a stator, a rotor, an air deflector member and an air directing surface. The rotor is configured to rotate relative to the stator for rotation about a rotor axis. The centrifugal fan is coupled to the rotor in a manner such that the centrifugal fan rotates with the rotor about the rotor axis. The air directing surface is shaped and configured to direct air drawn into the air inlet radially outwardly toward the impeller blades. The air directing surface has a first end and a second end. The air directing surface extends generally along the rotor axis from the first end to the second end. At least a surface region of the air directing surface generally circumscribes the rotor axis and diverges radially outwardly as such surface region of the air directing surface extends away from the first end of the air directing surface and toward the second end of the air directing surface. A surface of the air deflector member comprising at least a portion of said surface region of the air directing surface. The surface region of the air directing surface is axially aligned with portions of the impeller blades such that said surface region of the air directing surface is surrounded by said portions of the impeller blades. The air deflector member is shaped and configured such that to produce a given flow and pressure of the first blower assembly when the first blower assembly is in a conduit having a first and second planar surface perpendicular to the rotor axis with the first planar surface of the conduit spaced three inches from the first housing air inlet such that air upstream of the first housing air inlet is drawn radially inwardly into the first housing air inlet and with the second planar surface of the conduit spaced three inches from the second housing air inlet such that air upstream of the second housing air inlet is drawn radially inwardly into the second housing air inlet, the air deflector member reduces the energy required to power the motor assembly by at least 5% over the energy required to power a motor assembly of a second blower assembly that is identical to the first blower assembly and in an identical conduit with the exception that the second blower assembly is devoid of an air deflector member.

Another aspect of the present invention is a motor assembly adapted for use in a blower assembly. The motor assembly comprises a stator, a rotor configured to rotate relative to the stator for rotation about a rotor axis, at least one electronic component adapted and configured to control the motor and an air directing surface. The at least one electronic component is adjacent the stator. The air directing surface is shaped and configured to direct air moving generally axially along the rotor axis radially outwardly. The air directing surface has a first end and a second end. The air directing surface extends generally along the rotor axis from the first end to the second end. At least a surface region of the air directing surface generally circumscribes the rotor axis and diverges radially outwardly as such surface region of the air directing surface extends away from the first end of the air directing surface and toward the second end of the air directing surface. The air directing surface and said at least one electronic component are positioned relative to each other such that at least 75% by volume of said at least one electronic component is axially between the first and second ends of the air directing surface and surrounded by the air directing surface.

Another aspect of the present invention is a motor assembly adapted for use in a blower assembly. The motor assembly comprises a stator, a rotor configured to rotate relative to the stator for rotation about a rotor axis, and an air directing surface shaped and configured to direct air moving generally axially along the rotor axis radially outwardly. The air directing surface has a first end and a second end. The air directing surface extends generally along the rotor axis from the first end to the second end. At least a surface region of the air directing surface generally circumscribes the rotor axis and diverges radially outwardly as such surface region of the air directing surface extends away from the first end of the air directing surface and toward the second end of the air directing surface. The first end of the air directing surface has a diameter $d_1$ and the second end of the air directing surface has a diameter $d_2$, wherein the diameter $d_1$ is less than 50% of the diameter $d_2$. At least a portion of the rotor is axially between the first and second ends of the air directing surface and surrounded by the air directing surface.

Further features and advantages of the present invention, as well as the operation of the invention, are described in detail below with reference to the accompanying drawings.

Figure 1:
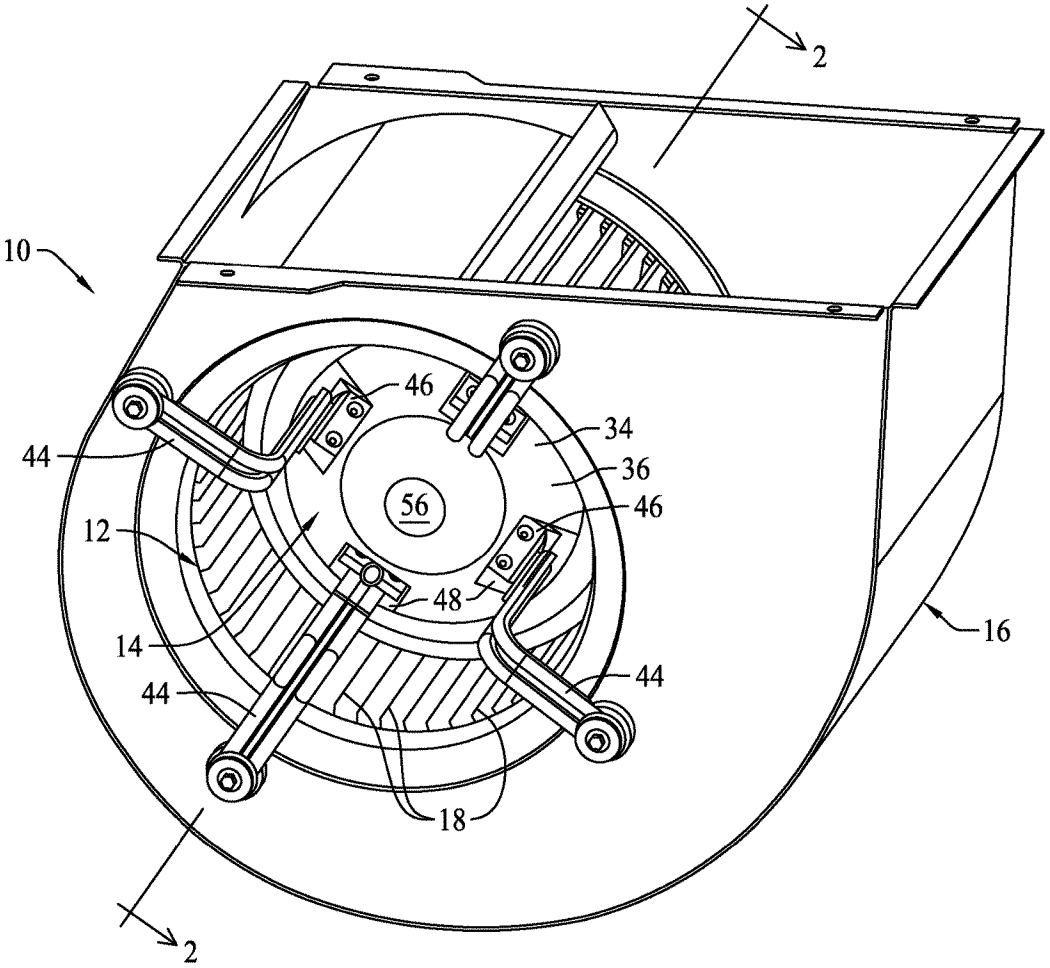
FIG. 1 is a perspective view of a blower assembly of a first embodiment of the present invention, the blower assembly including a centrifugal fan, a blower housing, and a motor assembly.

Reference numerals in the written specification and in the drawing figures indicate corresponding items.

DETAILED DESCRIPTION

Figure 2:
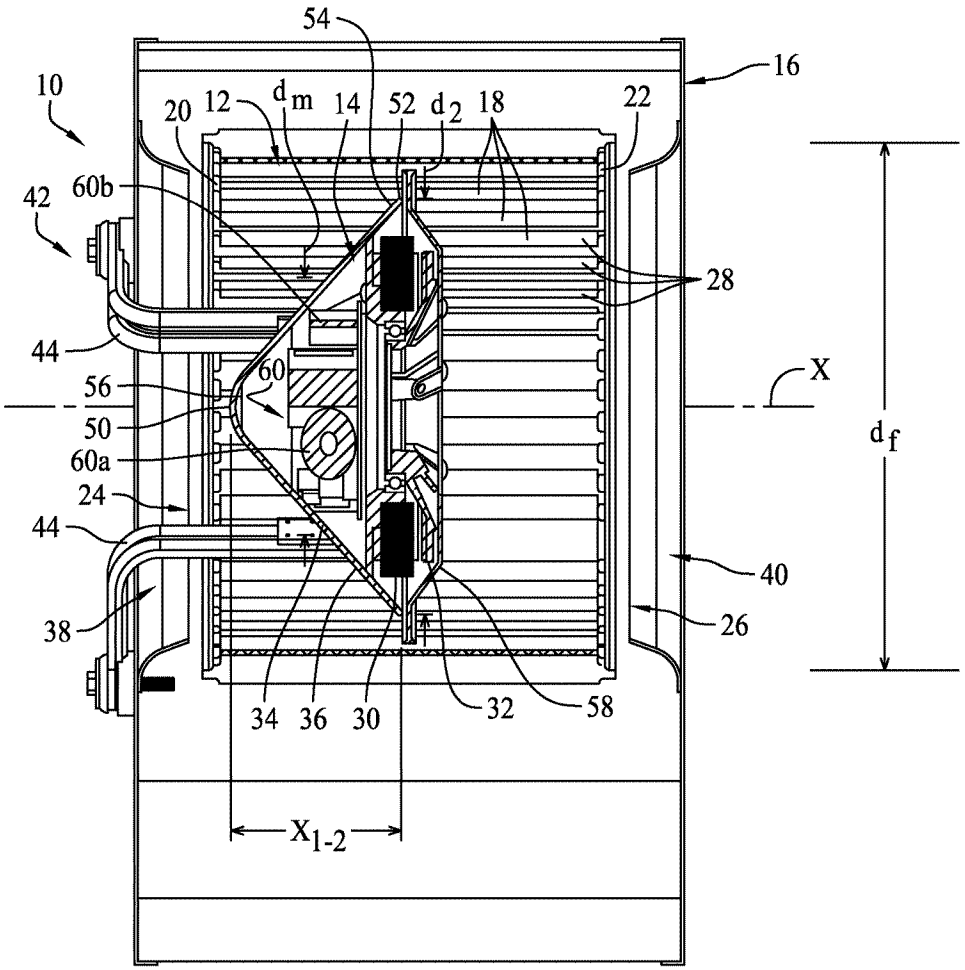
FIG. 2 is a sectional view taken along the plane of line 2-2 of FIG. 1.

A blower assembly in accordance with the invention is generally represented by the numeral 10 as shown in FIGS. 1 and 2. The blower assembly comprises a centrifugal fan, generally indicated at 12, a motor assembly, generally indicated at 14, and a blower housing, generally indicated at 16.

The centrifugal fan 12 is rotatable about a fan axis X. The centrifugal fan 12 has a plurality of axially extending impeller blades 18, a first axial end 20, a second axial end 22 opposite the first axial end, a first air inlet 24, and a second air inlet 26. The first air inlet 24 is at the first axial end 20 of the centrifugal fan 12. The second air inlet 26 is at the second axial end 22 of the centrifugal fan 12. The impeller blades 18 have inner surfaces 28 that combine to define a fan inner diameter $d_f$. The centrifugal fan 12 is journaled to the blower housing 16, preferably in any conventional manner, for rotation of the centrifugal fan relative to the blower housing about the fan axis X.

The motor assembly 14 comprises a stator 30, a rotor 32, an air deflector member 34 and an air directing surface 36. The motor assembly 14 comprises an axial flux motor, and comprises an electronically commutated motor. The motor assembly 14 may be entirely contained within the centrifugal fan 12. The rotor 32 is configured to rotate relative to the stator 30 for rotation about a rotor axis. The centrifugal fan is coupled to the rotor in a manner such that the centrifugal fan rotates with the rotor about the rotor axis, and preferably in a direct drive manner. Preferably the rotor axis is the same axis as the fan axis X. Thus, as used herein, the reference X applies equally to the rotor axis and the fan axis.

The blower housing 16 includes first and second housing air inlets 38, 40. The first housing air inlet 38 is generally adjacent the first air inlet 24 of the centrifugal fan 12. The second housing air inlet 40 is generally adjacent the second air inlet 26 of the centrifugal fan 12. As shown in FIGS. 1 and 2, the centrifugal fan may be entirely contained within the blower housing 16.

The blower assembly 10 further comprises a motor support bracket, generally indicated at 44. The motor support bracket 42 operatively secures the air deflector member 34 to the blower housing 16. The motor support bracket 42 operatively secures the motor assembly 14 to the blower housing 16 via the air deflector member 34. The motor support bracket 42 includes a plurality of leg members 44, but it is to be understood that other types of brackets could be employed without departing from the scope of this invention. Each leg member 44 includes a foot portion 46. Each foot portion 46 is within a corresponding foot receiving recess 48 in the air deflector member 34.

Preferably, the air directing surface 36 is operatively coupled to the stator 30 such that the air directing surface 36 remains stationary relative to the stator 30 as the rotor 32 and centrifugal fan 12 are rotated relative to the stator 30 about the rotor axis X. The air directing surface 36 of the motor assembly 14 is shaped and configured to direct air drawn into the first air inlet 24 radially outwardly toward the impeller blades 18. The air directing surface 36 has a first end 50 and a second end 52. The air directing surface 36 extends generally along the rotor axis X from the first end 50 to the second end 52. At least a surface region 54 of the air directing surface 36 generally circumscribes the rotor axis X and diverges radially outwardly as such surface region 54 of the air directing surface 36 extends away from the first end 50 of the air directing surface 36 and toward the second end 52 of the air directing surface 36. A surface of the air deflector member 34 comprises at least a portion of the surface region 54 of the air directing surface 36. The surface region 54 of the air directing surface 36 is axially aligned with portions of the impeller blades 18 (see FIG. 2) such that said surface region 54 of the air directing surface 36 is surrounded by said portions of the impeller blades 18. The first end 50 of the air directing surface 36 has a diameter $d_1$ and the second end 52 of the air directing surface 36 has a diameter $d_2$. The axial distance $X_{1-2}$ (FIG. 2) between the first and second ends 50, 52 of the air directing surface 36 is preferably at least 25% of the diameter $d_2$ of the second end 52 of the air directing surface 36, and is more preferably at least 33% of the diameter $d_2$. The diameter $d_1$ of the first end 50 of the air directing surface 36 is preferably less than 50% of the diameter $d_2$ of the second end 52 of the air directing surface 36, and more preferably is less than 40% of the diameter $d_2$, and more preferably is less than 30% of the diameter $d_2$, and more preferably is less than 20% of the diameter $d_2$, and more preferably is less than 10% of the diameter $d_2$. The diameter $d_2$ of the second end 52 of the air directing surface 36 is preferably at least 50% of the fan inner diameter $d_f$, and is more preferably at least 60% of the fan inner diameter $d_f$, and is more preferably at least 70% of the fan inner diameter $d_f$, and is more preferably at least 75% of the fan inner diameter $d_f$. The air directing surface 36 includes a mid-region which is generally midway axially between the first and second ends of the air directing surface 36, the mid-region of the air directing surface 36 having a diameter $d_m$. Preferably the diameter $d_m$ of the mid-region of the air directing surface 36 is less than 80% of the diameter $d_2$ of the second end 52 of the air directing surface 36. The diameter $d_1$ of the first end 50 of the air directing surface 36 is preferably less than 70% of the diameter $d_m$ of the mid-region of the air directing surface 36, and is more preferably less than 50% of the diameter $d_m$ of the mid-region of the air directing surface 36, and is more preferably less than 40% of the diameter $d_m$ of the mid-region of the air directing surface 36.

Figure 3:
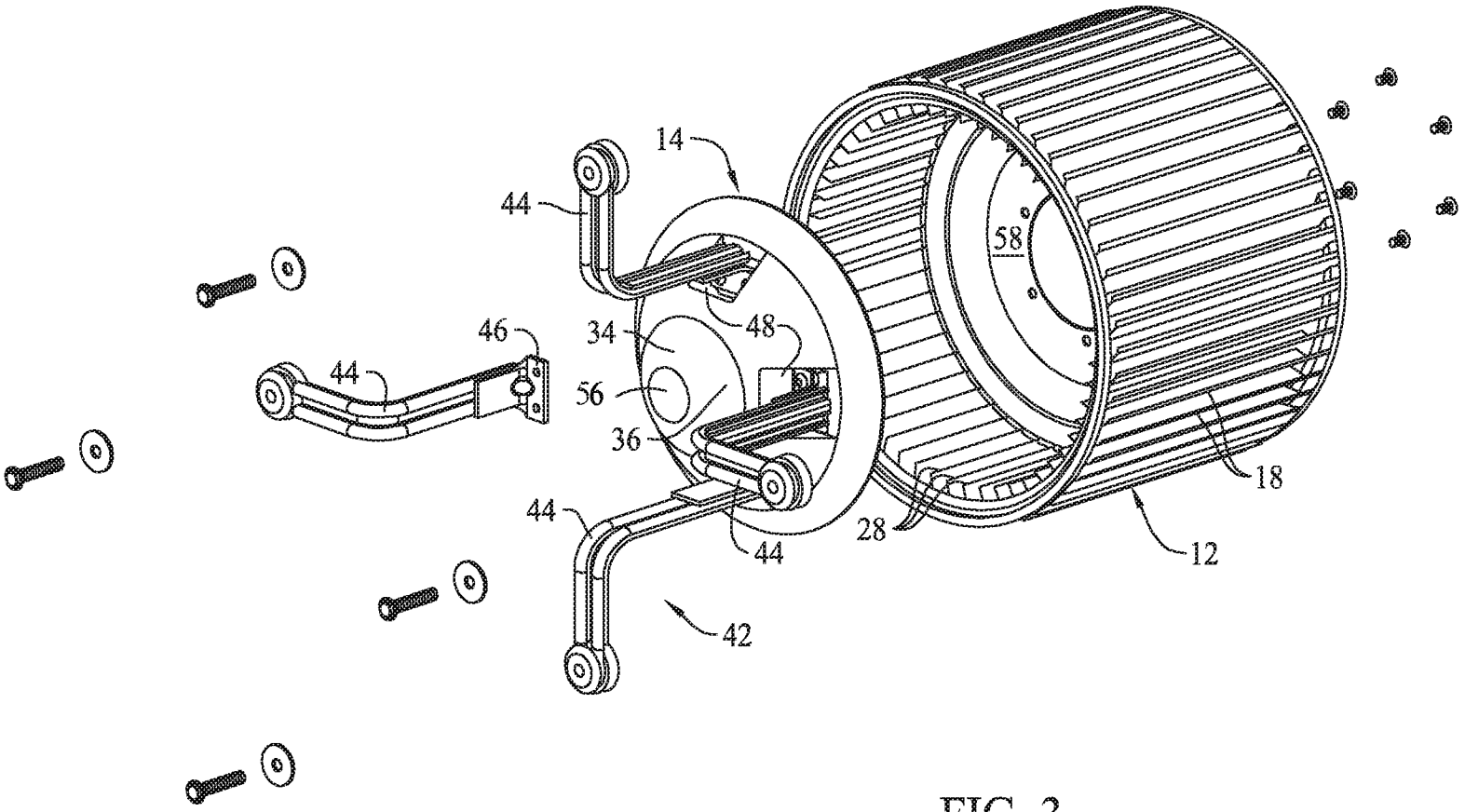
FIG. 3 is an exploded perspective view of the centrifugal fan and motor assembly of the blower assembly of FIG. 1.

In the embodiment of FIGS. 1-3, the surface region 54 of the air directing surface 36 has a generally circular cross section in a plane perpendicular to the rotor axis X. In particular, the air directing surface 36 of this embodiment comprises a conic section, and preferably a conic section of a right, circular cone. But it is to be understood that the surface region 54 of the air directing surface 36 may have other shapes without departing from the scope of the invention. For example, an alternative surface region of an air directing surface may have a polygonal cross section (e.g., a substantially equilateral polygon of six or more sides) in a plane perpendicular to the rotor axis. Another alternative surface region of an air directing surface may have a generally elliptical cross section in a plane perpendicular to the rotor axis. The air directing surface 36 of the preferred embodiment includes a nose region 56. The nose region 56 extends (i.e., projects) axially from the first end 50 of the air directing surface 36 toward the second end 52 of the air directing surface 36. Preferably, the nose region 56 diverges as it extends axially from the first end 50 toward the second end 52. Preferably, the nose region 56 has a curved cross section in a cross-sectional plane that includes the rotor axis. However, the nose region could alternatively be pointed or blunted without departing from the scope of the invention. The air directing surface 36 may comprise surface portions of a plurality of parts. For example, the nose region 56 may be an outer surface of a nose piece. Preferably, the air directing surface 36 diverges substantially continuously from the mid-region of the air directing surface 36 to the second end 52 of the air directing surface 36. The air directing surface 36 preferably diverges generally from its first end 50 toward its second end 52, and more preferably diverges generally from its first end 50 to its second end 52. In the embodiment shown in FIGS. 1-3, the air directing surface 36 diverges generally continuously from the first end 50 of the air directing surface 36 to the second end 52 of the air directing surface 36. Of course, it is to be understood that discontinuities may be present in diverging regions of the air directing surface 36 without departing from the scope of the invention. Preferably, the air directing surface 36 converges generally from its second end 2 toward the first end 50, but an end margin of the air directing surface 36 could have a non-diverging region without departing from the scope of the invention.

Referring to FIG. 2, the second end 52 of the air directing surface 36 generally circumscribes a portion of the rotor 32, and at least a portion of the rotor 32 is axially between the first and second ends 50, 52 of the air directing surface 36 and surrounded by the air directing surface 36. Similarly, at least a portion of the stator 30 is axially between the first and second ends 50, 52 of the air directing surface 36 and surrounded by the air directing surface 36.

The centrifugal fan 12 may include a drive plate 58 between the first and second axial ends 20, 22 of the centrifugal fan, with the rotor 32 of the motor assembly 14 being operatively coupled to drive plate 58 of the centrifugal fan. The second end 52 of the air directing surface 36 may be generally adjacent the drive plate 58. The drive plate 58 may be located substantially midway between the first and second axial ends 20, 22 of the centrifugal fan 12, but may alternatively be closer to one of the first and second axial ends. The drive plate 58 may be generally annular in shape.

The motor assembly 14 of the present embodiment further includes at least one electronic component 60 (FIG. 2) adapted and configured to control a function of the motor assembly. The electronic component 60 may be surrounded by the air directing surface 36. The electronic component 60 may be positioned relative to the air directing surface 36 such that at least 75% by volume of the electronic component 60 is axially between the first and second ends of the air directing surface 36 and surrounded by the air directing surface 36. The at least one electronic component 60 may comprise a plurality of electronic components 60*a*, 60*b* adapted and configured to control the motor assembly. The plurality of electronic components may be positioned relative to the air directing surface 36 such that at least 75% by volume of said plurality of electronic components is axially between the first and second ends 50, 52 of the air directing surface 36 and surrounded by the air directing surface 36.

second planar surfaces 82, 84 perpendicular to the rotor axis X with the first planar surface 82 of the conduit spaced three inches from the first housing air inlet 38 such that air upstream of the first housing air inlet 38 is drawn radially inwardly into the first housing air inlet 38, and with the second planar surface 84 of the conduit 80 spaced three inches from the second housing air inlet 40 such that air upstream of the second housing air inlet 40 is drawn radially inwardly into the second housing air inlet 40. The air deflector member 34 is shaped and configured such that to produce a given exhaust flow (e.g., 1450 cfm) and pressure (e.g., 0.5 in-wc) of the first blower assembly 10 when the first blower assembly 10 is in the test conduit 80, the air deflector member 34 reduces the energy required to power the blower assembly 10 by at least 5% (and by at least 10%) over the energy required to power a second blower assembly that is identical to the first blower assembly and in an identical conduit with the exception that the second blower assembly is devoid of an air deflector member 34. In other words, to produce the same flow and pressure, less energy is required to power the blower assembly 10 with the air deflector member 34 than would be required to produce to power the motor assembly without the air deflector member. Thus, the presence of the air deflector member 34 and the presence of the air directing surface 36 increase the efficiency of the blower assembly 10.

Experiments were conducted to compare efficiencies of blower/motor assemblies with and without an air deflector member. In particular, a standard cylindrically-shaped motor coupled to a blower having a 10-10 impeller (designated in the below table as Blower/Motor Assembly A) was compared with a motor assembly having an air deflector member and coupled to a blower having a 10-10 impeller (designated in the below table as Blower/Motor Assembly B). Each of the two blower/motor assemblies was tested in a twenty inch wide appliance box, similar to that shown in FIGS. 4 and 5. The results of the experiments are tabulated in the following table:

| Unit tested | Test Configuration | CFM | Non-Corrected Pressure (in-wc) | Static Blower Eff in appliance | Blower Effect Energy Savings |
|---|---|---|---|---|---|
| Blower/Motor Assembly A | 20" Wide Appliance Box | 1750.02 | 0.5 | 0.337 | 13.65% |
| Blower/Motor Assembly B | 20" Wide Appliance Box | 1750.52 | 0.5 | 0.383 | |
| Blower/Motor Assembly A | 20" Wide Appliance Box | 1750.82 | 0.75 | 0.384 | 13.80% |
| Blower/Motor Assembly B | 20" Wide Appliance Box | 1750.97 | 0.75 | 0.437 | |
| Blower/Motor Assembly A | 20" Wide Appliance Box | 1450.27 | 0.5 | 0.389 | 11.57% |
| Blower/Motor Assembly B | 20" Wide Appliance Box | 1450.42 | 0.5 | 0.434 | |
| Blower/Motor Assembly A | 20" Wide Appliance Box | 1450.02 | 1 | 0.442 | 9.50% |
| Blower/Motor Assembly B | 20" Wide Appliance Box | 1450.54 | 1 | 0.484 | |

It is envisioned that in general use, the blower assembly 10 will be employed in a conduit, such as a conduit of an HVAC system. The air directing surface 36 is shaped and configured such that to produce a given flow and pressure within a conduit, the air directing surface 36 reduces the energy required to power the blower assembly by at least 5% (and by at least 10%) over the energy required to power a second blower assembly (not shown) that is identical to the blower assembly 14 with the exception that the second blower assembly is devoid of an air directing surface 36. In other words, the motor assembly of the second blower assembly is a typical cylindrically shaped motor assembly.

Figure 4:
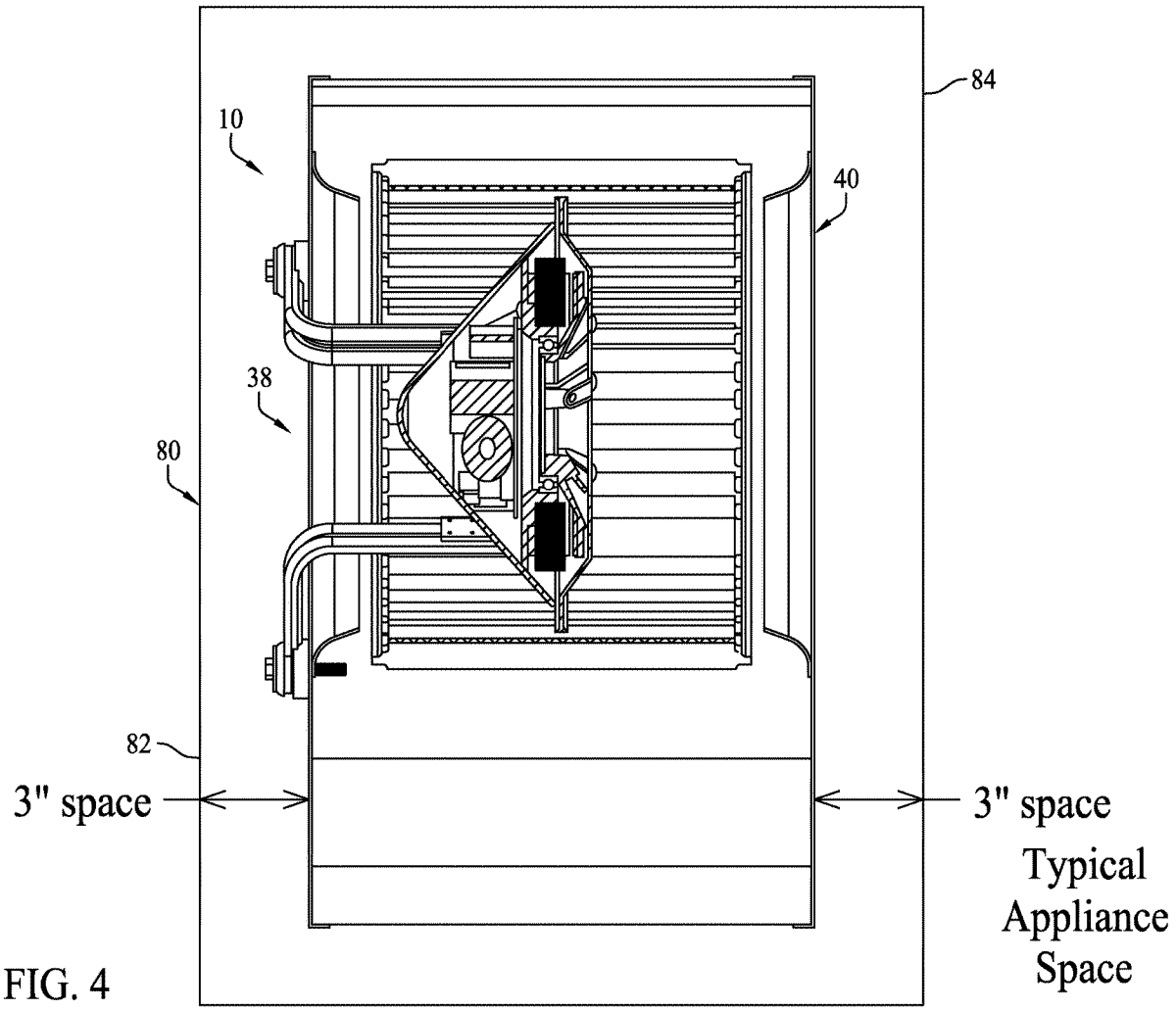
FIG. 4 is a cross-sectional view of the blower assembly of FIGS. 1-3 in a test conduit.
Figure 5:
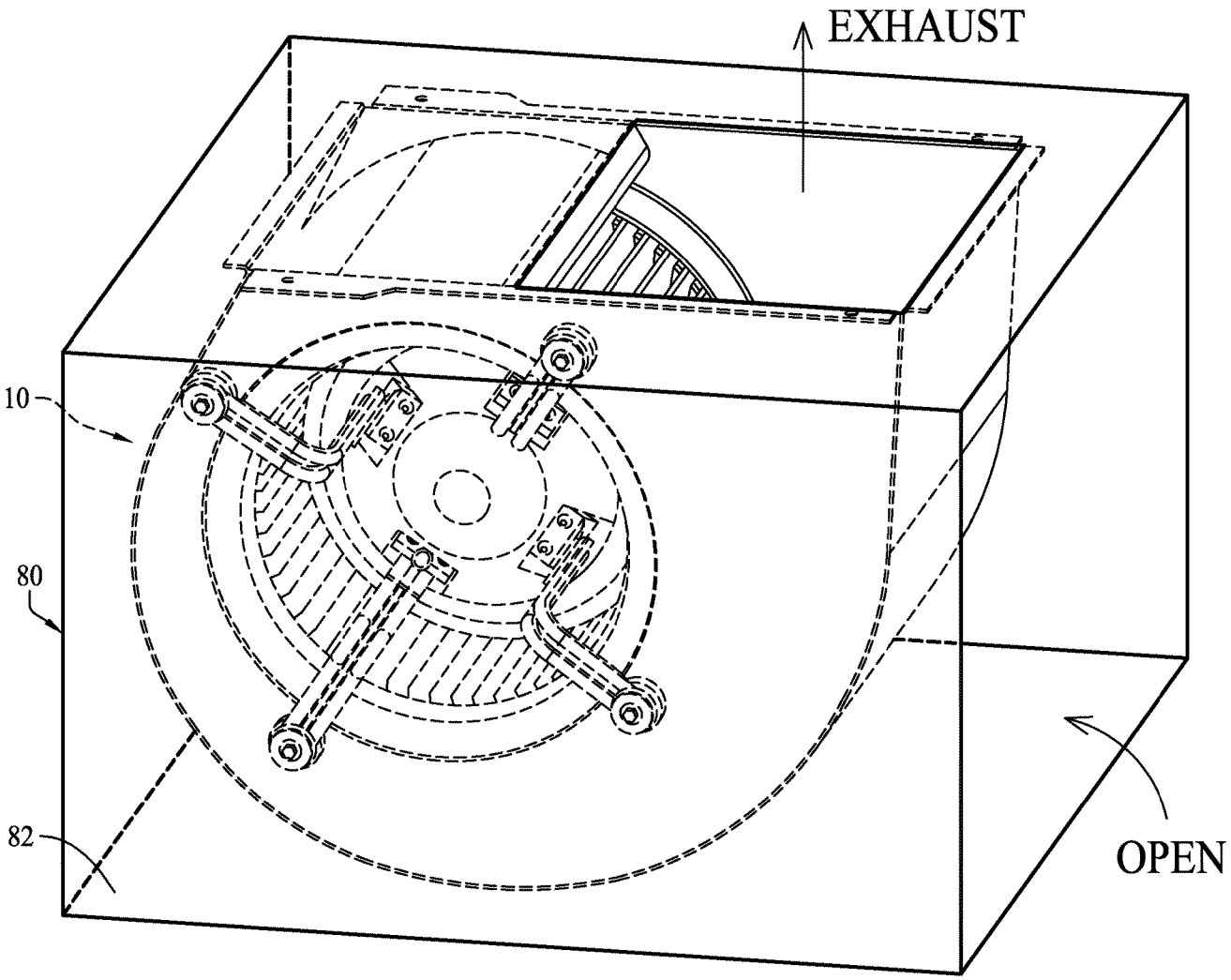
FIG. 5 is a perspective view of the blower assembly and test conduit of FIG. 4.

Referring to FIGS. 4 and 5, the blower assembly 10 is shown in a test conduit 80. The test conduit 80 has first and As shown in the table, the presence of the air deflector member results in substantially higher blower efficiencies.

Figure 6:
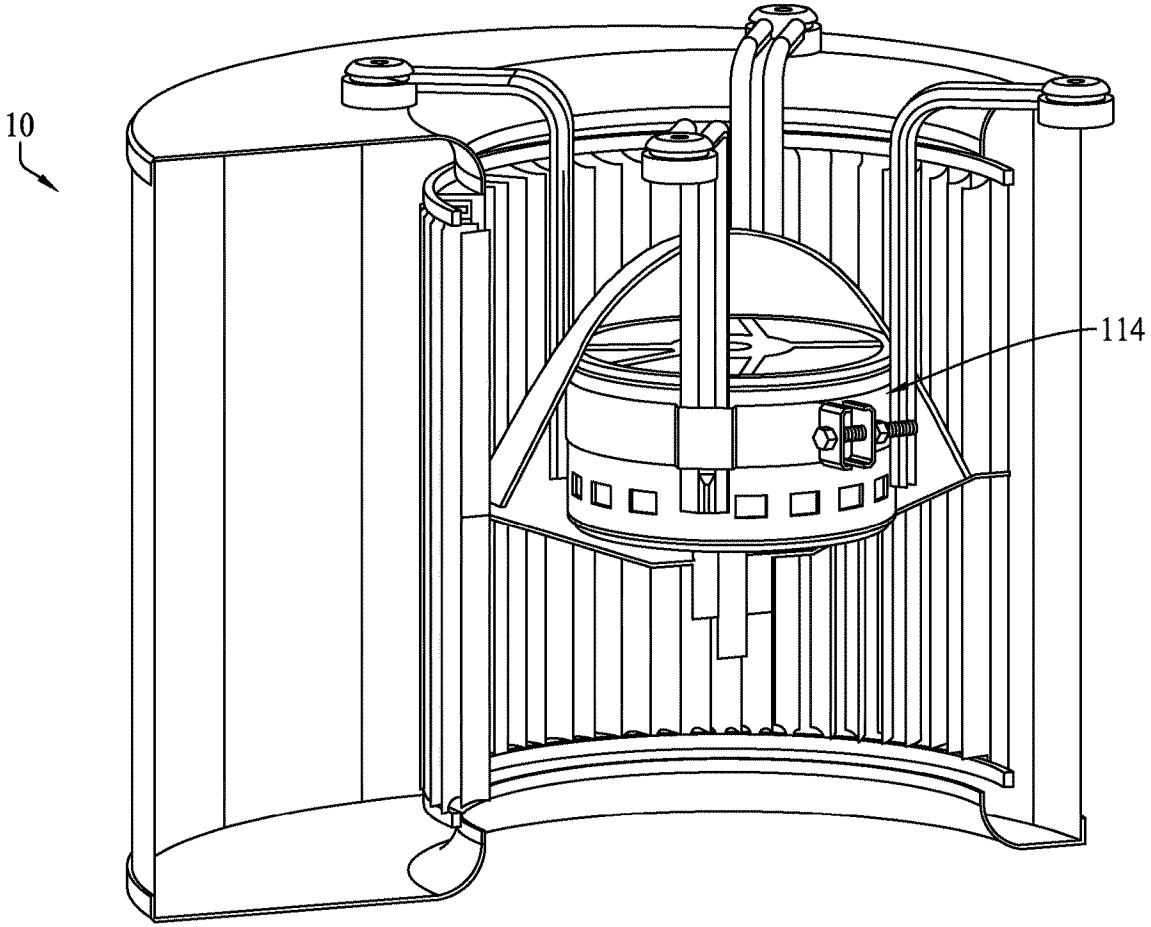
FIG. 6 is a fragmented perspective view of a blower assembly of a second embodiment of the present invention, the blower assembly of FIG. 4 being similar to the blower assembly of FIG. 1, but having a radial flux motor instead of an axial flux motor.

FIG. 6 shows an alternative blower assembly 110 with a motor assembly 114. The motor assembly 114 is essentially the same as the motor assembly 14 of FIGS. 1-3, except the motor assembly 114 includes a radial flux motor instead of an axial flux motor. For purposes herein, the description above with respect to the embodiment of FIGS. 1-3 applies also the embodiment of FIG. 6. Thus, a further description of the embodiment of FIG. 6 is unnecessary.

As various modifications could be made in the constructions herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A blower assembly comprising:

a centrifugal fan rotatable about a fan axis, the centrifugal fan having a plurality of axially extending impeller blades, a first axial end, a second axial end, a first air inlet, a second air inlet, and a drive plate between the first and second axial ends of the centrifugal fan, the second axial end being opposite the first axial end, the first air inlet being at the first axial end of the centrifugal fan, the second air inlet being at the second axial end of the centrifugal fan, the drive plate being between the first and second axial ends of the centrifugal fan, the impeller blades having inner surfaces that combine to define a fan inner diameter $d_f$;

a motor assembly comprising a stator, a rotor, at least one electronic component adapted and configured to control the motor assembly, and an air directing surface, the rotor being configured to rotate relative to the stator about a rotor axis, the rotor of the motor assembly being operatively coupled to the drive plate of the centrifugal fan in a manner such that the centrifugal fan rotates with the rotor about the rotor axis, said at least one electronic component being adjacent the stator, the air directing surface being shaped and configured to direct air drawn into the air inlet radially outwardly toward the impeller blades, the air directing surface having a first end and a second end, the air directing surface extending generally along the rotor axis from the first end to the second end, at least a surface region of the air directing surface generally circumscribing the rotor axis and diverging radially outwardly as such surface region of the air directing surface extends away from the first end of the air directing surface and toward the second end of the air directing surface, said surface region of the air directing surface being axially aligned with portions of the impeller blades such that said surface region of the air directing surface is surrounded by said portions of the impeller blades, the first end of the air directing surface having a diameter $d_1$ and the second end of the air directing surface having a diameter $d_2$, the diameter $d_1$ being less than 50% of the diameter $d_2$ and the diameter $d_2$ being at least 50% of the fan inner diameter $d_f$, the second end of the air directing surface being generally adjacent the drive plate.

2. A blower assembly as set forth in claim 1 wherein the axial distance between the first and second ends of the air directing surface is at least 25% of the diameter $d_2$, and wherein the air directing surface includes a mid-region which is generally midway axially between the first and second ends of the air directing surface, the mid-region of the air directing surface having a diameter $d_m$, the diameter $d_m$ is less than 80% of the diameter $d_2$, the diameter $d_1$ is less than 70% of the diameter $d_m$.

3. A blower assembly as set forth in claim 1 wherein the drive plate is located substantially midway between the first and second axial ends of the centrifugal fan.

4. A blower assembly as set forth in claim 1 wherein the motor assembly comprises an axial flux motor.

5. A blower assembly as set forth in claim 1 further comprising an air deflector member, a surface of the air deflector member comprising at least a portion of the air directing surface.

6. A blower assembly as set forth in claim 5 further comprising a motor support bracket, the motor support bracket operatively securing the air deflector member to the blower housing.

7. A blower assembly comprising:

a centrifugal fan rotatable about a fan axis, the centrifugal fan having a plurality of axially extending impeller blades, a first axial end, a second axial end, an air inlet, and a drive plate, the air inlet being at the first axial end of the centrifugal fan, the impeller blades having inner surfaces that combine to define a fan inner diameter $d_f$, the drive plate located between the first and second axial ends of the centrifugal fan, the rotor of the motor assembly being operatively coupled to the drive plate of the centrifugal fan;

a motor assembly comprising a stator, a rotor configured to rotate relative to the stator about a rotor axis, and an air directing surface shaped and configured to direct air moving generally axially along the rotor axis radially outwardly, the air directing surface having a first end and a second end, the air directing surface extending generally along the rotor axis from the first end to the second end, at least a surface region of the air directing surface generally circumscribing the rotor axis and diverging radially outwardly as such surface region of the air directing surface extends away from the first end of the air directing surface and toward the second end of the air directing surface, the first end of the air directing surface has a diameter $d_1$ and the second end of the air directing surface has a diameter $d_2$, wherein the diameter $d_1$ is less than 30% of the diameter $d_2$, the axial distance between the first and second ends of the air directing surface being at least 25% of the diameter $d_2$, the centrifugal fan being coupled to the rotor in a manner such that the centrifugal fan rotates with the rotor about the rotor axis, the air directing surface being shaped and configured to direct air drawn into the air inlet radially outwardly toward the impeller blades.

8. A blower assembly as set forth in claim 7 wherein the second end of the air directing surface is generally adjacent the drive plate.

9. A first blower assembly comprising:

a centrifugal fan rotatable about a fan axis, the centrifugal fan having a plurality of axially extending impeller blades, a first axial end, and an air inlet, the air inlet being at the first axial end of the centrifugal fan, the impeller blades having inner surfaces that combine to define a fan inner diameter $d_f$;

a motor assembly comprising a stator, a rotor, and an air directing surface, the rotor being configured to rotate relative to the stator about a rotor axis, the centrifugal fan being coupled to the rotor in a manner such that the centrifugal fan rotates with the rotor about the rotor axis, the air directing surface being shaped and configured to direct air drawn into the air inlet radially outwardly toward the impeller blades, the air directing surface having a first end and a second end, the air directing surface extending generally along the rotor axis from the first end to the second end, at least a surface region of the air directing surface generally circumscribing the rotor axis and diverging radially outwardly as such surface region of the air directing surface extends away from the first end of the air directing surface and toward the second end of the air directing surface, said surface region of the air directing surface being axially aligned with portions of the impeller blades such that said surface region of the air directing surface is surrounded by said portions of the impeller blades, the air directing surface being shaped and configured such that to produce a given flow and pressure, the air directing surface reduces the energy required to power the blower assembly by at least 5% over the energy required to power a second blower assembly that is identical to the first blower assembly with the exception that the second blower assembly is devoid of an air directing surface.

10. A first blower assembly as set forth in claim 9 wherein the air directing surface is operatively coupled to the stator such that the air directing surface remains stationary relative to the stator as the rotor and centrifugal fan are rotated relative to the stator about the rotor axis.

11. A first blower assembly as set forth in claim 9 wherein the first end of the air directing surface has a diameter $d_1$ and the second end of the air directing surface has a diameter $d_2$, diameter $d_1$ is less than 50% of the diameter $d_2$ and wherein the diameter $d_2$ is at least 50% of the fan inner diameter $d_f$.

12. A first blower assembly as set forth in claim 11 wherein the air directing surface includes a mid-region which is generally midway axially between the first and second ends of the air directing surface, the mid-region of the air directing surface having a diameter $d_m$, the diameter $d_m$ is less than 80% of the diameter $d_2$, the diameter $d_1$ is less than 70% of the diameter $d_m$.

13. A first blower assembly as set forth in claim 12 wherein the diameter $d_1$ is less than 40% of the diameter $d_2$.

14. A first blower assembly as set forth in claim 12 wherein the diameter $d_2$ is at least 75% of the fan inner diameter $d_f$.

15. A first blower assembly as set forth in claim 14 wherein the diameter $d_1$ is less than 50% of the diameter $d_m$.

16. A first blower assembly as set forth in claim 15 wherein the air directing surface diverges substantially continuously from the mid-region of the air directing surface to the second end of the air directing surface.

17. A first blower assembly as set forth in claim 11 wherein the air directing surface includes a mid-region which is generally midway axially between the first and second ends of the air directing surface, the mid-region of the air directing surface having a diameter $d_m$, the diameter $d_m$ is less than 60% of the diameter $d_2$, the diameter $d_1$ is less than 50% of the diameter $d_m$.

18. A first blower assembly as set forth in claim 11 wherein the axial distance between the first and second ends of the air directing surface is at least 33% of the diameter $d_2$.

19. A first blower assembly as set forth in claim 9 wherein the second end of the air directing surface generally circumscribes a portion of the rotor.

20. A first blower assembly comprising:

a centrifugal fan rotatable about a fan axis, the centrifugal fan having a plurality of axially extending impeller blades, a first axial end, and an air inlet, the air inlet being at the first axial end of the centrifugal fan, the impeller blades having inner surfaces that combine to define a fan inner diameter $d_f$;

a motor assembly comprising a stator, a rotor, an air deflector member and an air directing surface, the rotor being configured to rotate relative to the stator about a rotor axis, the centrifugal fan being coupled to the rotor in a manner such that the centrifugal fan rotates with the rotor about the rotor axis, the air directing surface being shaped and configured to direct air drawn into the air inlet radially outwardly toward the impeller blades, the air directing surface having a first end and a second end, the air directing surface extending generally along the rotor axis from the first end to the second end, at least a surface region of the air directing surface generally circumscribing the rotor axis and diverging radially outwardly as such surface region of the air directing surface extends away from the first end of the air directing surface and toward the second end of the air directing surface, a surface of the air deflector member comprising at least a portion of said surface region of the air directing surface, said surface region of the air directing surface being axially aligned with portions of the impeller blades such that said surface region of the air directing surface is surrounded by said portions of the impeller blades, the air deflector member being shaped and configured such that to produce a given flow and pressure, the air deflector member reduces the energy required to power the blower assembly by at least 5% over the energy required to power a second blower assembly that is identical to the first blower assembly with the exception that the second blower assembly is devoid of an air deflector member.

21. A first blower assembly as set forth in claim 20 wherein the air directing surface includes a mid-region which is generally midway axially between the first and second ends of the air directing surface, the mid-region of the air directing surface having a diameter $d_m$, the first end of the air directing surface having a diameter $d_1$, the second end of the air directing surface having a diameter $d_2$, the diameter $d_m$ is less than 80% of the diameter $d_2$, the diameter $d_1$ is less than 70% of the diameter $d_m$.

22. A first blower assembly as set forth in claim 21 wherein the diameter $d_1$ is less than 10% of the diameter $d_2$.

23. A first blower assembly as set forth in claim 21 wherein the diameter $d_2$ is at least 60% of the fan inner diameter $d_f$.

24. A first blower assembly comprising:

a centrifugal fan rotatable about a fan axis, the centrifugal fan having a plurality of axially extending impeller blades, a first axial end, a second axial end opposite the first axial end, a first air inlet, a second air inlet, the first air inlet being at the first axial end of the centrifugal fan, the second air inlet being at the second axial end of the centrifugal fan, the impeller blades having inner surfaces that combine to define a fan inner diameter $d_f$;

a blower housing, the centrifugal fan being journaled to the blower housing for rotation of the centrifugal fan relative to the blower housing about the fan axis, the blower housing including first and second housing air inlets, the first housing air inlet being generally adjacent the first air inlet of the centrifugal fan, the second housing air inlet being generally adjacent the second air inlet of the centrifugal fan;

a motor assembly comprising a stator, a rotor, an air deflector member and an air directing surface, the rotor being configured to rotate relative to the stator about a rotor axis, the centrifugal fan being coupled to the rotor in a manner such that the centrifugal fan rotates with the rotor about the rotor axis, the air directing surface being shaped and configured to direct air drawn into the air inlet radially outwardly toward the impeller blades, the air directing surface having a first end and a second end, the air directing surface extending generally along the rotor axis from the first end to the second end, at least a surface region of the air directing surface generally circumscribing the rotor axis and diverging radially outwardly as such surface region of the air directing surface extends away from the first end of the air directing surface and toward the second end of the air directing surface, a surface of the air deflector member comprising at least a portion of said surface region of the air directing surface, said surface region of the air directing surface being axially aligned with portions of the impeller blades such that said surface region of the air directing surface is surrounded by said portions of the impeller blades, wherein the air deflector member is shaped and configured such that to produce a given flow and pressure of the first blower assembly when the first blower assembly is in a conduit having a first and second planar surface perpendicular to the rotor axis with the first planar surface of the conduit spaced three inches from the first housing air inlet such that air upstream of the first housing air inlet is drawn radially inwardly into the first housing air inlet and with the second planar surface of the conduit spaced three inches from the second housing air inlet such that air upstream of the second housing air inlet is drawn radially inwardly into the second housing air inlet, the air deflector member reduces the energy required to power the blower assembly by at least 5% over the energy required to power a second blower assembly that is identical to the first blower assembly and in an identical conduit with the exception that the second blower assembly is devoid of an air deflector member.

25. A first blower assembly as set forth in claim 24 wherein the air directing surface includes a nose region, the nose region extending axially from the first end of the air directing surface toward the second end of the air directing surface, the nose region having a curved cross section in a cross-sectional plane that includes the rotor axis.

26. A blower assembly comprising:

a centrifugal fan rotatable about a fan axis, the centrifugal fan having a plurality of axially extending impeller blades, a first axial end, and an air inlet, the air inlet being at the first axial end of the centrifugal fan, the impeller blades having inner surfaces that combine to define a fan inner diameter $d_f$, the centrifugal fan including a drive plate between the first and second axial ends of the centrifugal fan, the rotor of the motor assembly being operatively coupled to drive plate of the centrifugal fan;

a motor assembly comprising a stator, a rotor configured to rotate relative to the stator about a rotor axis, and an air directing surface shaped and configured to direct air moving generally axially along the rotor axis radially outwardly, the air directing surface having a first end and a second end, the air directing surface extending generally along the rotor axis from the first end to the second end, at least a surface region of the air directing surface generally circumscribing the rotor axis and diverging radially outwardly as such surface region of the air directing surface extends away from the first end of the air directing surface and toward the second end of the air directing surface, the first end of the air directing surface has a diameter $d_1$ and the second end of the air directing surface has a diameter $d_2$, wherein the diameter $d_1$ is less than 30% of the diameter $d_2$, at least a portion of the rotor being axially between the first and second ends of the air directing surface and surrounded by the air directing surface, the centrifugal fan being coupled to the rotor in a manner such that the centrifugal fan rotates with the rotor about the rotor axis, the air directing surface being shaped and configured to direct air drawn into the air inlet radially outwardly toward the impeller blades.

27. A blower assembly as set forth in claim 26 wherein the second end of the air directing surface is generally adjacent the drive plate.

28. A blower assembly as set forth in claim 27 wherein the diameter $d_2$ is at least 75% of the fan inner diameter $d_f$.

* * * * *